US006484825B2

(12) United States Patent
Watson et al.

(10) Patent No.: US 6,484,825 B2
(45) **Date of Patent: *Nov. 26, 2002**

(54) CUTTING STRUCTURE FOR EARTH BORING DRILL BITS

(75) Inventors: Dean Watson, Cheltenham (GB); Steve Barton, Aldbourne (GB)

(73) Assignee: Camco International (UK) Limited (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/682,298

(22) Filed: Aug. 16, 2001

(65) Prior Publication Data

US 2002/0100617 A1 Aug. 1, 2002

Related U.S. Application Data

(63) Continuation-in-part of application No. 09/791,052, filed on Feb. 22, 2001.

(30) Foreign Application Priority Data

Jan. 27, 2001 (GB) ..... 0102160

(51) Int. Cl.[7] ..... E21B 10/26
(52) U.S. Cl. ..... 175/374; 175/393; 175/406
(58) Field of Search ..... 175/331, 374, 175/393, 406, 434, 73

(56) References Cited

U.S. PATENT DOCUMENTS 5,163,524 A 11/1992 Newton, Jr. et al.
5,265,682 A 11/1993 Russell et al.
5,553,679 A 9/1996 Thorp
5,582,259 A 12/1996 Barr
5,603,385 A 2/1997 Colebrook
5,685,379 A 11/1997 Barr et al.
5,706,905 A 1/1998 Barr
5,778,992 A 7/1998 Fuller
5,803,185 A 9/1998 Barr et al.
5,967,247 A 10/1999 Pessler
6,092,613 A * 7/2000 Caraway et al. ..... 175/393
6,321,862 B1 * 11/2001 Beuershausen et al. ..... 175/406

FOREIGN PATENT DOCUMENTS

GB 2 294 069 4/1996
GB 2 352 745 2/2001

* cited by examiner

*Primary Examiner*—William Neuder
(74) *Attorney, Agent, or Firm*—Jeffery E. Daly

(57) ABSTRACT

A drill bit for drilling a borehole having a bit body with an axis of rotation, a leading face, and a plurality of blades upstanding from the leading face. At least one of the blades terminates in a gauge pad having a gauge surface arranged, in use, to face a wall of the borehole. The gauge surface being devoid of cutting elements and terminating at an end remote from the blade at a junction with a gauge pad end wall. The gauge pad carries a cutter having a face and a cutting edge located radially inward of the gauge surface, and the junction of the gauge surface and the gauge pad end wall crosses, radially, between the face of the cutter and the wall of the borehole. The gauge surface may be a substantially continuous surface, and may have at least one additional cutter located angularly between two adjacent blades of the drill bit.

32 Claims, 7 Drawing Sheets

CUTTING STRUCTURE FOR EARTH BORING DRILL BITS

CROSS REFERENCE TO RELATED APPLICATIONS

This application is a Continuation-in-part of U.S. patent application Ser. No. 09/791,052 filed on Feb. 22, 2001 currently pending.

BACKGROUND OF INVENTION

1. Field of the Invention

This invention relates to earth boring drill bits, and in particular to a fixed cutter drill bit having cutting elements positioned so as to facilitate directional drilling.

2. Description of the Related Art

Until quite recently, drill bit designers worked primarily on designing drill bits which would drill straight holes through the earth. More recently, designers have been working on bit designs which, when used in conjunction with suitable downhole equipment, can be steered to permit directional drilling. In directional drilling, it is important to ensure that the drill bit does not wander from the desired path. In addition, the bits must be easy to steer and be able to hold a horizontal drilling trajectory.

There are two common ways to steer a drill bit. One method is to use a downhole motor to rotate the drill bit, the motor and drill bit being mounted upon a drill string including an angled bend. In such an arrangement, the direction of drilling is dependent upon the angular position of the drill string. In use, the drill string is rotated until the drill bit is pointing in the desired direction. The drill string is then held against further angular movement while drilling in the desired direction takes place. This steering technique is sometimes known as "pointing the bit".

An alternative steering technique is known as "push the bit". In this technique, the drill bit is rotated continuously. Associated with the drill bit is a unit designed to permit the application of a side load to the drill bit to cause the direction of drilling to deviate from the straight path it would otherwise follow. U.S. Pat. Nos. 5,265,682; 5,553,679; 5,582,259; 5,603,385; 5,685,379; 5,706,905; 5,778,992; 5,803,185 all incorporated herein by reference for all they disclose, describe a unit suitable for use in a "push the bit" type steerable drilling system.

A known drill bit suitable for use in a steerable drilling system of the "push the bit" type has a leading face from which a plurality of blades upstand, each blade carrying a plurality of cutting elements. Each blade terminates in a gauge pad. In a typical drill bit, the gauge pads are not provided with cutting elements, but may be provided with inserts designed to improve the wear resistance of the gauge pads. It has been found, however, to be advantageous in a "push the bit" type system to provide the gauge pads with cutting elements. One disadvantage, however, of applying cutting elements to the gauge pads is that there is a tendency for a wellbore formed using the drill bit to drop. This is due to the gravitational effects experienced by the drill bit, the effect being greatest where a horizontal bore is to be drilled, the gravitational effects applying a side loading to the drill bit causing the cutters of the gauge pads located at the lower side of the bit at any given time to become active in drilling the borehole.

SUMMARY OF INVENTION

The present invention provides a drill bit particularly suitable for use in a steerable drilling system of the "push the bit" type.

According to the present invention there is provided a drill bit for drilling a borehole, the drill bit comprising a bit body having an axis of rotation, a leading face, a plurality of blades upstanding from the leading face, at least one of the blades terminating in a gauge pad having a gauge surface arranged, in use, to face a wall of the borehole, the gauge surface being devoid of cutting elements, the gauge surface terminating at an end thereof remote from the blade at a junction with a gauge pad end wall, wherein the gauge pad carries a single cutter having a face and a cutting edge located radially inward of the gauge surface, and wherein the junction of the gauge surface and the gauge pad end wall crosses, radially, between the face of the cutter and the wall of the borehole.

Preferably each blade terminates in a similar gauge pad, each gauge pad carrying a single cutter. Each cutter conveniently comprises a table of a superhard material bonded to a substrate. The superhard material preferably comprises diamond.

The cutting edge is preferably spaced radially inward of the gauge surface by a distance greater than about 0.15 mm, and preferably between about 0.2 mm and 0.5 mm.

A line drawn between the cutting edge and the junction conveniently makes an angle with the axis of the bit of less than about 0.1°.

According to another aspect of the invention there is provided a drill bit for drilling a borehole, the drill bit comprising a bit body having an axis of rotation, a leading face, a plurality of blades upstanding from the leading face, at least one of the blades terminating in a gauge pad having a gauge surface arranged, in use, to face a wall of the borehole, the gauge surface being devoid of cutting elements, the gauge surface terminating at an end thereof remote from the blade at a junction with a gauge pad end wall, wherein the gauge pad carries a single cutter having a face and a cutting edge located radially inward of the gauge surface, the radial spacing of the cutting edge from the gauge surface being greater than about 0.15 mm.

According to yet another aspect of the invention there is provided a drill bit for drilling a borehole, the drill bit comprising a bit body having an axis of rotation, a leading face, a plurality of blades upstanding from the leading face, at least one of the blades terminating in a gauge pad having a gauge surface arranged, in use, to face a wall of the borehole, the gauge surface being devoid of cutting elements, the gauge surface terminating at an end thereof remote from the blade at a junction with a gauge pad end wall, wherein the gauge pad carries a single cutter having a face and a cutting edge located radially inward of the gauge surface, and wherein a notional line between the junction and the cutting edge makes an angle with the axis of rotation of less than about 0.1°.

According to another aspect of the invention there is provided a drill bit for drilling a borehole, the drill bit comprising a bit body having an axis of rotation, a leading face, a plurality of blades upstanding from the leading face, at least one of the blades terminating in a gauge pad having a gauge surface arranged, in use, to face a wall of the borehole, the gauge surface being devoid of cutting elements, the gauge surface terminating at an end thereof remote from the blade at a junction with a gauge pad end wall, wherein the gauge pad carries a single cutter having a face and a cutting edge located radially inward of the gauge surface, and wherein an axial position of the junction of the gauge surface and the gauge pad end wall lies between an axial position of an edge of the cutter face closest to the blade and an axial position of an edge thereof furthest from the blade.

According to a further aspect of the invention there is provided a steerable drilling system for use in the drilling of a borehole comprising a bottom hole assembly (BHA) adapted to permit control over the direction of drilling of a drill bit, the drill bit comprising a bit body having a plurality of blades, at least one of the blades terminating in a gauge pad having a gauge surface devoid of cutting elements, the gauge pad having, at an end thereof remote from the blade, a gauge pad end wall, the gauge pad carrying a single cutter located inward of the gauge surface and such that an axial position of a junction between the gauge surface and the gauge pad end wall lies between an axial position of an edge of the cutter closest to the blade and an axial position of an edge of the cutter furthest from the blade.

The bottom hole assembly (BHA) may be of the "push the bit" type including a bias unit arranged to apply a side loading to the bit. Alternatively, the bottom hole assembly may be of the "point the bit" type, including a downhole motor for rotating the drilling bit, and an angled member arranged to permit the bit to be supported in a desired orientation relative to an axis of the borehole.

It is envisaged that the drill bit may be used in a drilling system which is, in effect, a combination of the "push the bit" and "point the bit" types, the system including, for example, a bias unit arranged to apply a side loading to a bent unit which carries a motor, the motor carrying the drill bit. In such an arrangement, when the system is to be used to drill a curve, the drill string is held against rotation with the bent unit holding the drill bit in the desired orientation while the motor drives the drill bit, and the bias unit is operated to apply a side loading to the bent unit and the drill bit.

Where a side loading is applied to a bit, either by a bias unit to which the bit is connected or by a bias arrangement forming part of the bit, it is thought to be advantageous for the "single cutter" referred to hereinbefore to be located on a side part of the bit directly opposite the bias unit pad causing the application of the side loading at any given time. Although this is possible where the number of "single cutters" is equal to or a multiple of the number of bias unit pads, it requires the drill bit to be correctly angularly orientated relative to the bias unit, where the bias unit is a separate component. Obviously, if the number of "single cutters" is not equal to or a multiple of the number of bias unit pads, then such positioning cannot be achieved with the arrangements described hereinbefore.

Accordingly, in each of the arrangements hereinbefore, the gauge pads may be integral with one another and form a gauge surface extending around the bit body, additional similarly located cutters being carried by the bit body between the angular positions of the blades.

By providing additional similarly located cutters, the requirement for the bias unit pad to be located opposite one of the blades is removed. The bit therefore can be used with a wide range of bias units and there is no need to accurately angularly align the bit with the bias unit.

According to another aspect of the invention there is provided a drill bit for drilling a borehole, the drill bit comprising a bit body having an axis of rotation, a leading face, a plurality of blades upstanding from the leading face, and a gauge surface extending around the bit body and arranged, in use, to face a wall of the borehole, the gauge surface being devoid of cutting elements, the gauge surface terminating at an edge thereof remote from the blades at a junction with a gauge pad end wall, wherein the bit body carries a plurality of cutters each having a face and a cutting edge located radially inward of the gauge surface, and wherein the junction of the gauge surface and the gauge pad end wall crosses, radially, between the face of each cutter and the wall of the borehole.

BRIEF DESCRIPTION OF DRAWINGS

The invention will further be described, by way of example, with reference to the accompanying drawings.

DETAILED DESCRIPTION

Figure 1:
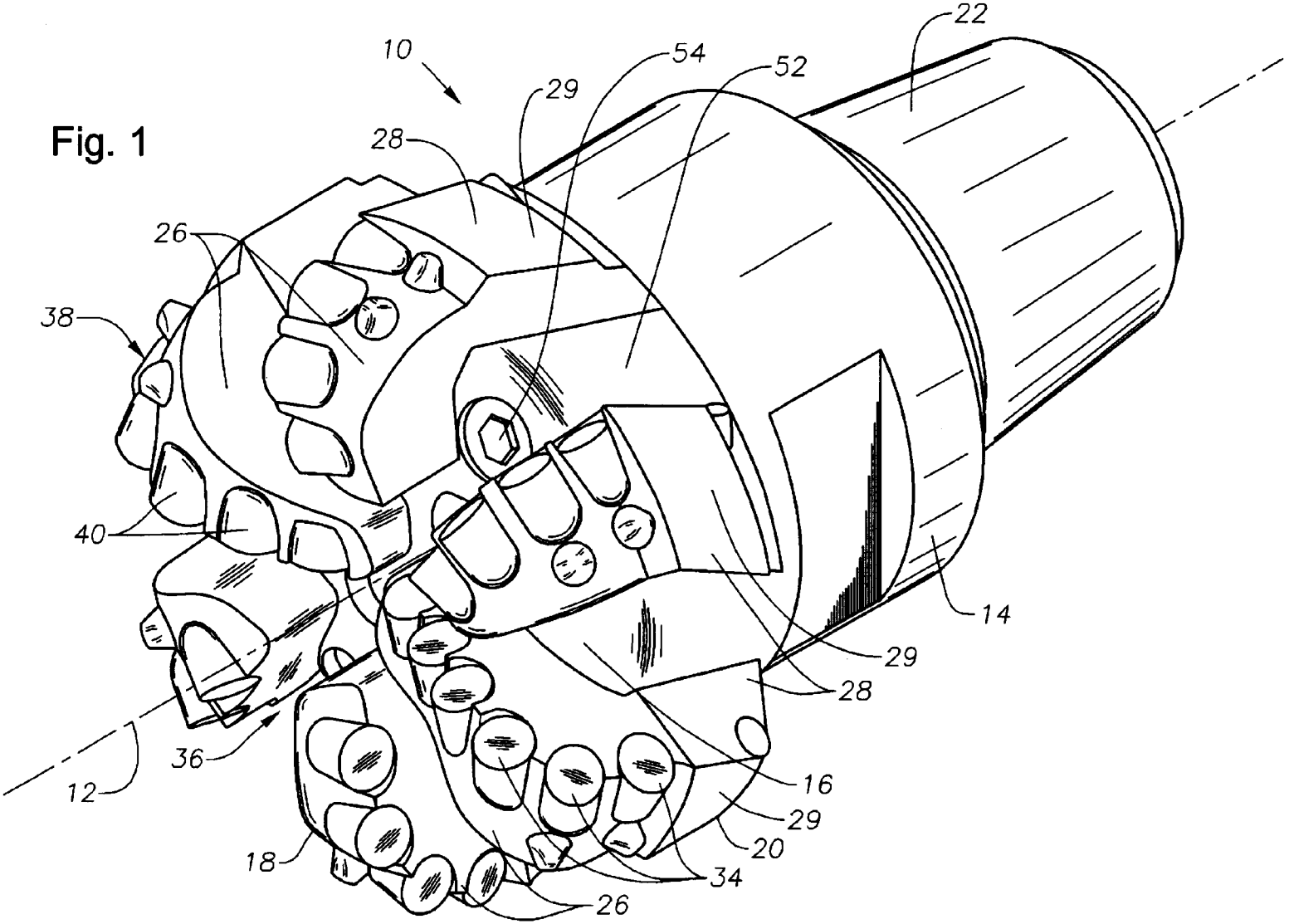
FIG. 1 is a perspective view of an earth boring drill bit in accordance with an embodiment of the invention.
Figure 3:
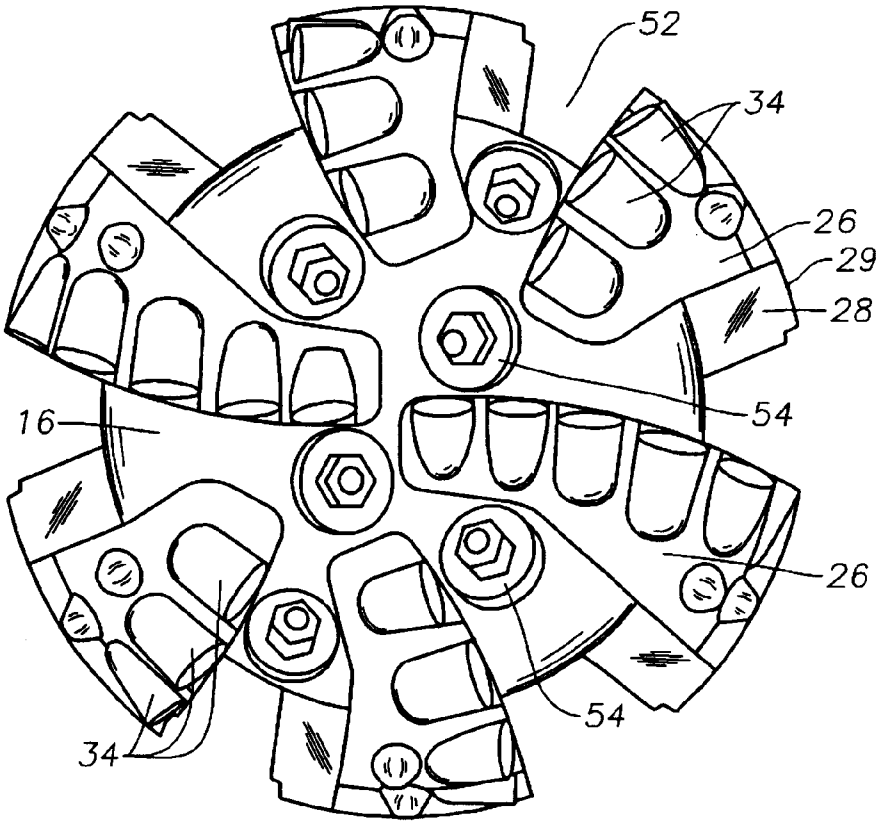
FIG. 3 is a bottom view of the drill bit of FIG. 1.
Figure 2:
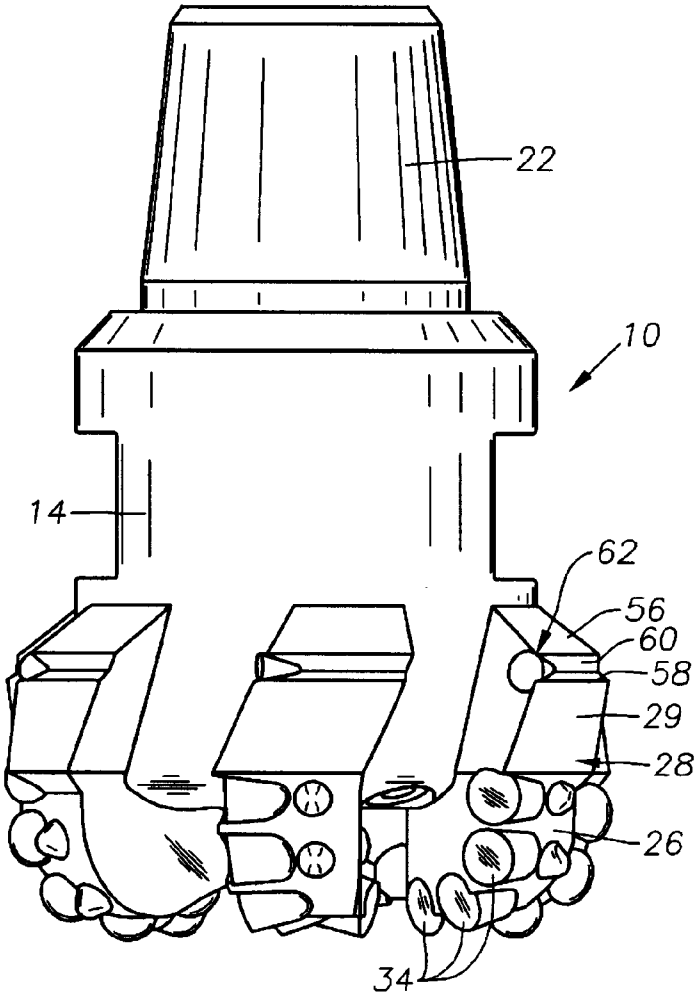
FIG. 2 is a side view of the drill bit of FIG. 1.
Figure 5:
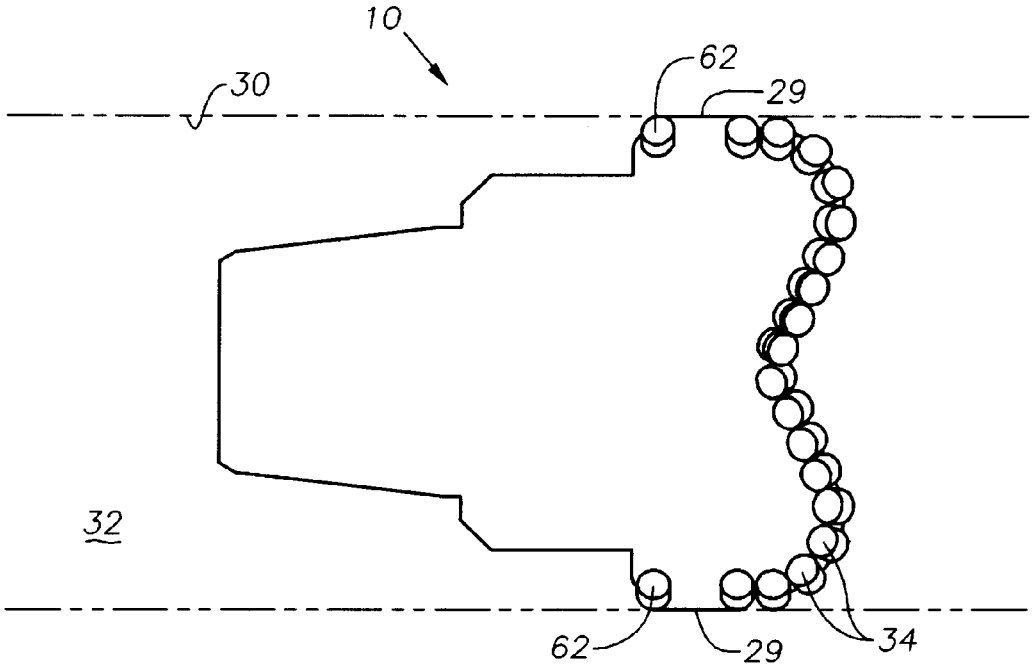
FIGS. 5 and 6 are diagrammatic views illustrating the use of the drill bit in drilling a borehole.
Figure 6:
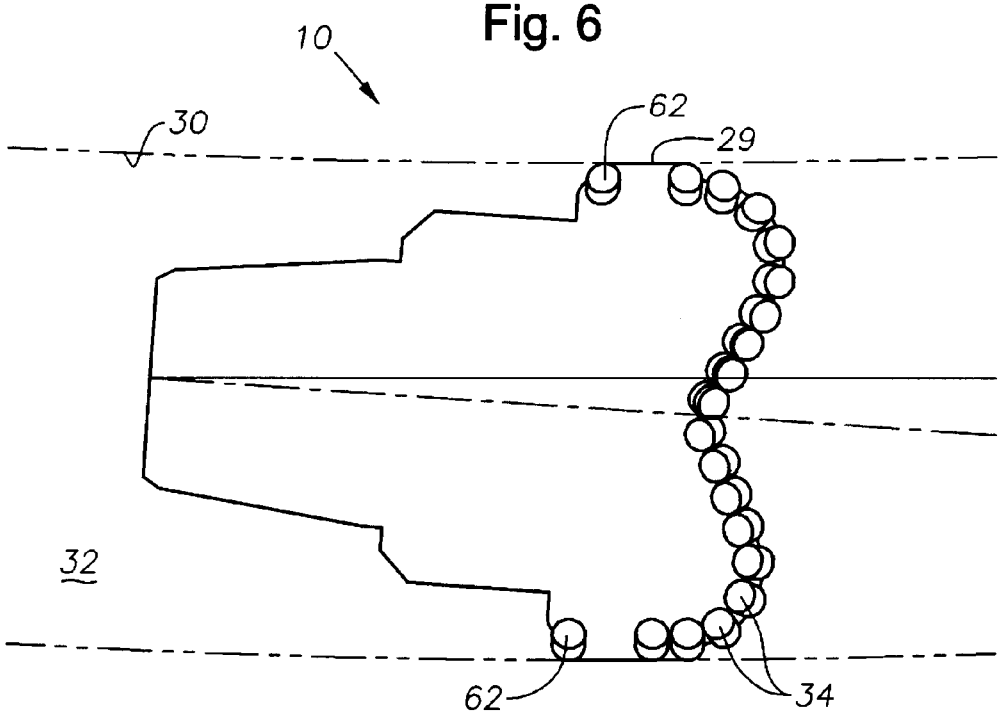

Referring now to FIGS. 1 to 3, a fixed cutter drill bit of the present invention is illustrated and generally designated by the reference numeral 10. The drill bit 10 has a central axis of rotation 12 and a bit body 14 having a leading face 16, an end face 18, a gauge region 20, and a shank 22 for connection to a drill string. A plurality of blades 26 are upstanding from the leading face 16 of the bit body and extend outwardly away from the central axis of rotation 12 of the bit 10. Each blade 26 terminates in a gauge pad 28 having a gauge surface 29 which faces a wall 30 of the borehole 32 (as shown in FIGS. 5 and 6).

A number of cutters 34 are mounted on the blades 26 at the end face 18 of the bit 10 in both a cone region 36 and a shoulder region 38 of the end face 18.

Each of the cutters 34 partially protrude from their respective blade 26 and are spaced apart along the blade 26, typically in a given manner to produce a particular type of cutting pattern. Many such patterns exist which may be suitable for use on the drill bit 10 fabricated in accordance with the teachings provided herein.

A cutter 34 typically includes a preform cutting element 40 that is mounted on a carrier in the form of a stud which is secured within a socket in the blade 26. Typically, each preform cutting element 40 is a curvilinear shaped, preferably circular tablet of polycrystalline diamond compact (PDC) or other suitable superhard material bonded to a substrate of tungsten carbide, so that the rear surface of the tungsten carbide substrate may be brazed into a suitably oriented surface on the stud which may also be formed from tungsten carbide.

While the leading face 16 of the drill bit 10 is responsible for cutting the underground formation, the gauge region 20 is generally responsible for stabilizing the drill bit 10 within the borehole 32. The gauge region 20 typically includes extensions of the blades 26 which create channels 52 through which drilling fluid may flow upwardly within the borehole 32 to carry away the cuttings produced by the leading face 16. To facilitate stabilization of the bit without performing a cutting action, the gauge pads 28 are arranged such that the gauge surfaces 29 thereof are devoid of cutters. Although not included in the illustrated embodiment, the gauge surfaces 29 may be provided with means to improve the wear resistance thereof, for example wear resistant inserts or a coating of hard facing material. Such means do not result in the gauge surfaces performing a cutting action but rather simply improve the wear resistance of these parts of the drill bit.

Within the bit body 14 is passaging (not shown) which allows pressurized drilling fluid to be received from the drill string and communicate with one or more orifices 54 located on or adjacent to the leading face 16. These orifices 54 accelerate the drilling fluid in a predetermined direction. The surfaces of the bit body 14 are susceptible to erosive and abrasive wear during the drilling process. A high velocity drilling fluid cleans and cools the cutters 34 and flows along the channels 52, washing the earth cuttings away from the end face 18. The orifices 54 may be formed directly in the bit body 14, or may be incorporated into a replaceable nozzle.

Figure 7:
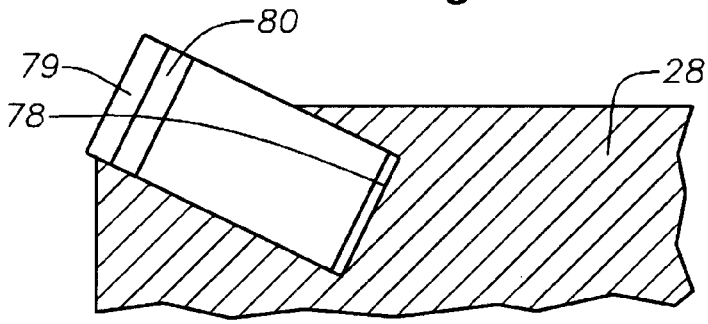
FIG. 7 is another diagrammatic view of part of the drill bit.

As shown in the drawings, at its end remote from the blade 26 each gauge pad 28 terminates at an end wall 56. The end wall 56 is angled relative to the axis 12. The end wall 56 joins the gauge surface 29 at a junction 58. In the arrangement illustrated in FIGS. 1 to 3, the end wall 56 is not of planar form, but rather is shaped to define a step 60. It will be appreciated, however, that the provision of such a step 60 is not essential, and that the end wall 56 could extend continuously to the junction 58. In the region of the end wall 56, the gauge pad 28 is shaped to define a socket 78 (see FIG. 7) which receives a cutter 62 orientated aggressively. The cutter 62 conveniently takes the form of a polycrystalline diamond compact tablet 79, conveniently of circular shape, mounted upon a suitable substrate 80, for example of tungsten carbide, the substrate 80 being brazed to the bit body. The tablet 79 defines a generally planar face 64, part of the periphery of which defines a cutting edge 65. The location of the cutter 62 is such as to ensure that the cutting edge 65 is located radially inward of the gauge surface. The location of the cutter 62 relative to the junction 58 is such that the junction 58, radially, extends between the face 64 of the cutter 62 and the wall 30 of the borehole 32.

Put another way, the axial position 72 of the junction 58 lies between the axial position 74 of the edge 75 of the cutter 62 closest to the blade 26 and the axial position 76 of the edge 77 furthest from the blade 26.

Although as described hereinbefore the tablet 79 is conveniently of circular shape, it will be appreciated that this need not be the case and the tablet 79 (and substrate 80) may be of other shapes. FIGS. 4A and 4B illustrate two possible alternative shapes, the cutter shown in FIG. 4A being of pointed form whereas that of FIG. 4B is shaped to define a flat. It will be appreciated that these shapes are only examples and that the cutter could take a number of other shapes.

Figure 4:
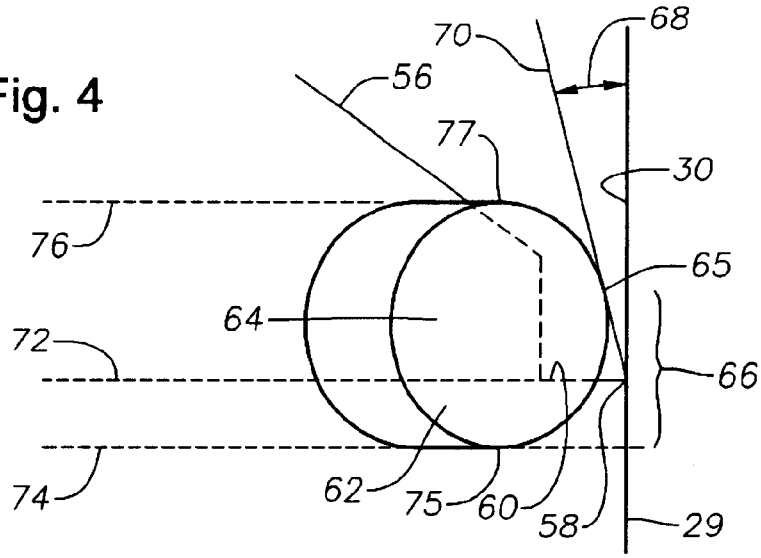
FIG. 4 is a diagrammatic view of part of the drill bit.
Figure 4A:
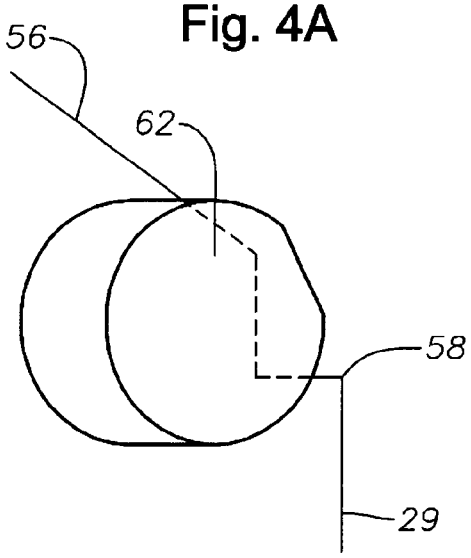
FIGS. 4A and 4B are views similar to FIG. 4 illustrating alternative arrangements.
Figure 4B:
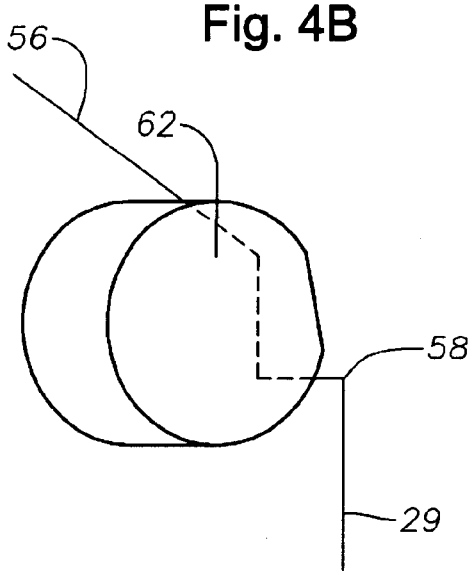

The positioning of the cutter 62 relative to the gauge surface 29 is illustrated most clearly in FIG. 4. As shown in FIG. 4, the cutting edge 65 of the cutter 62 is spaced radially inwardly of the gauge surface 29, and the junction 58 crosses between the face 64 of the tablet of the cutter 62 and the wall 30 of the borehole 32. Although FIG. 4 illustrates one suitable position of the cutter 62 relative to the junction 58, it will be appreciated that the relative positioning of the cutter 62 and the junction 58 may be changed without falling outside of the scope of the invention, and the bracket 66 of FIG. 4 denotes a range of suitable positions of the junction 58 relative to the face 64 of the cutter 62. The radial spacing of the cutting edge 65 of the cutter 62 from the gauge surface 29 is very small, and is conveniently greater than about 0.15 mm, and preferably between about 0.2 mm and about 0.5 mm. A notional line 70 drawn between the cutting edge 65 of the cutter 62 and the junction 58 conveniently makes an angle with the axis 12 of less than about 0.1°. In the arrangement illustrated, this angle (denoted by reference 68 in FIG. 4) is conveniently approximately 0.0785 °.

FIGS. 5 and 6 illustrate the drill bit in use, the description being directed to the use of the drill bit with a "push the bit" type system.

When the drill bit is being used to drill a straight part of a borehole 32, as shown in FIG. 5, no side loading is applied to the drill bit 10 by the bias unit of the bottom hole assembly, and the drill bit 10 lies substantially coaxial with the borehole. It will be appreciated that, in these circumstances, even when the drill bit lies horizontally, and thus experiences gravitational side loadings, the drill bit is supported by the gauge surfaces 29 of the gauge pads 28. As the cutters 62 are spaced radially inward of the gauge surfaces 29, it will be appreciated that these cutters are out of contact with the wall 30 of the borehole 32 and so do not perform a drilling function. The provision of the cutters 62 does not, therefore, have the effect of causing the borehole to drop.

If the bias unit 84 of the bottom hole assembly is operated to apply a side loading to the drill bit 10, for example as illustrated in FIG. 6, then this will have the effect of tilting the drill bit 10 relative to the axis of the bore. If the tilting of the drill bit 10 is in the direction illustrated in FIG. 6, then the tilting will cause the cutters 62 on the high or upper side of the drill bit 10 at any given time to move towards the wall 30, the cutters 62 on the low side of the drill bit 10 tending to move away from the wall 30. The tilting of the drill bit will also tend to move the cutters 34 provided on the blades 26 at the high side of the bit 10 away from the wall 30 whereas those at the low side of the bit 10 still encounter the well bore and so are active in drilling. Since the cutters 62 are radially inwardly spaced from the gauge surfaces 29, clearly the bit 10 must be moved through an angle greater than a predetermined angle in order to bring the cutters 62 into engagement with the wellbore. In the illustrated embodiment, this angle is approximately 0.4°. Once the bit 10 has been tilted through a sufficiently large angle to bring the cutters 62 at the high side of the bit 10 at any given time into engagement with the wellbore, then it will be appreciated that these cutters assist in drilling of the formation and thus assist in the formation of a curve in the wellbore.

Although in the description hereinbefore the cutting edge 65 of each cutter 62 is described as being spaced radially inwardly of the gauge surface radius by a distance of greater than about 0.15 mm, and preferably between about 0.2 mm and about 0.5 mm, and a notional line drawn between the junction 58 and the cutting edge 65 makes an angle with the axis 12 of less than about 0.1°, it will be appreciated that the positioning of the cutters 62 will depend upon the equipment with which the drill bit is to be used, the factors to be taken into account including, for example, whether the drill bit is to be used with an undersize downhole stabilizer unit 82.

Figure 8:
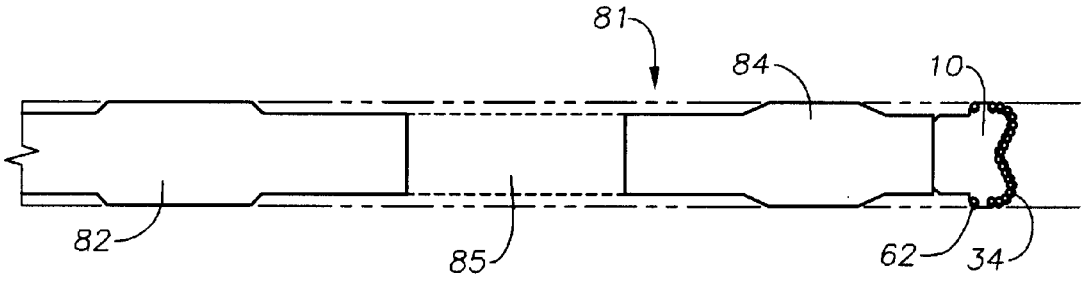
FIGS. 8 to 10 are diagrammatic views illustrating drilling systems including drill bits in accordance with the invention.

FIG. 8 illustrates a drill bit of the type described hereinbefore in use with a "push the bit" type drilling system. As shown in FIG. 8, the drilling system includes a bottom hole assembly (BHA) 81 comprising a stabilizer unit 82 connected to a bias unit 84, the bias unit in turn being connected to the drill bit. As is well known, the bias unit 84 is designed to rotate with the drill string by which the bottom hole assembly 81 is supported, the bias unit 84 including a plurality of moveable pads (not shown), the pads being moveable outwardly to engage the wall of the borehole being drilled to apply a side force to the bias unit, and hence to the drill bit. The bias unit 84 includes a control arrangement 85 adapted to ensure that the pads are extended and retracted at the correct time and in the correct positions to apply the side load to the drill bit in the desired direction to achieve drilling in the desired trajectory. Although the nature of the bias unit 84 is not described in detail, it will be appreciated that further details of the bias unit are set out in the patents referred to hereinbefore.

Figure 9:
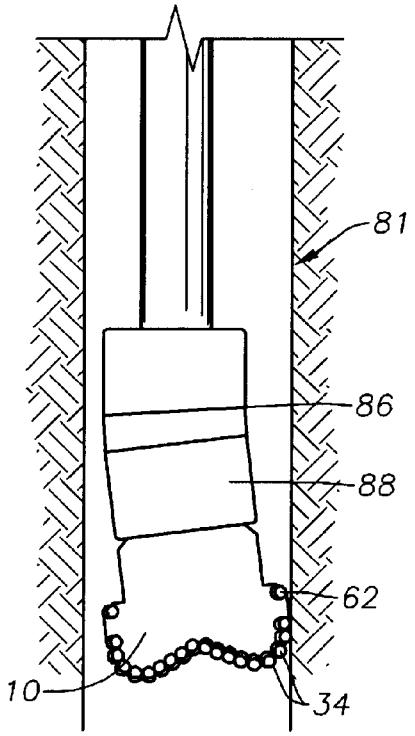

FIG. 9 illustrates the drill bit in use in a "point the bit" type drilling system. In this drilling system, the drill string carries a bent or articulated unit 86 which in turn carries a downhole motor 88. The motor is typically driven using wellbore fluid. The motor 88 is arranged to drive the drill bit to rotate the drill bit 10 about its axis. Again, a stabilizer unit (not shown) is typically incorporated into the bottom hole assembly 81.

In this arrangement, the motor 88 is used to drive the drill bit for rotation so that the drill bit performs a cutting action. As the motor and drill bit are carried by the bent unit 86, it will be appreciated that the axis of the drill bit is not coaxial with the borehole being drilled. When a straight portion of borehole is to be drilled (as shown), then the drill string is rotated so that the bent unit rotates within the wellbore. When a curved portion of wellbore is to be formed, then the drill string is held against rotation with the bent unit 86 orientated such that the drill bit is pointing in the direction in which the wellbore is to be drilled, and it will be appreciated that in this condition the drill bit is tilted such that the cutters 62 can become active.

Although the description herein is of a bottom hole assembly 81 including a bent unit, it will be appreciated that other "point the bit" type units are possible. For example, arrangements are known in which rather than use a permanently bent unit, the unit is adjustable between a position in which the drill bit lies coaxially with the bore and a condition in which the axis of the drill bit is angled relative to the bore. Further, the assembly 81 could incorporate a bias unit designed to apply a side loading to the drill bit.

Figure 10:
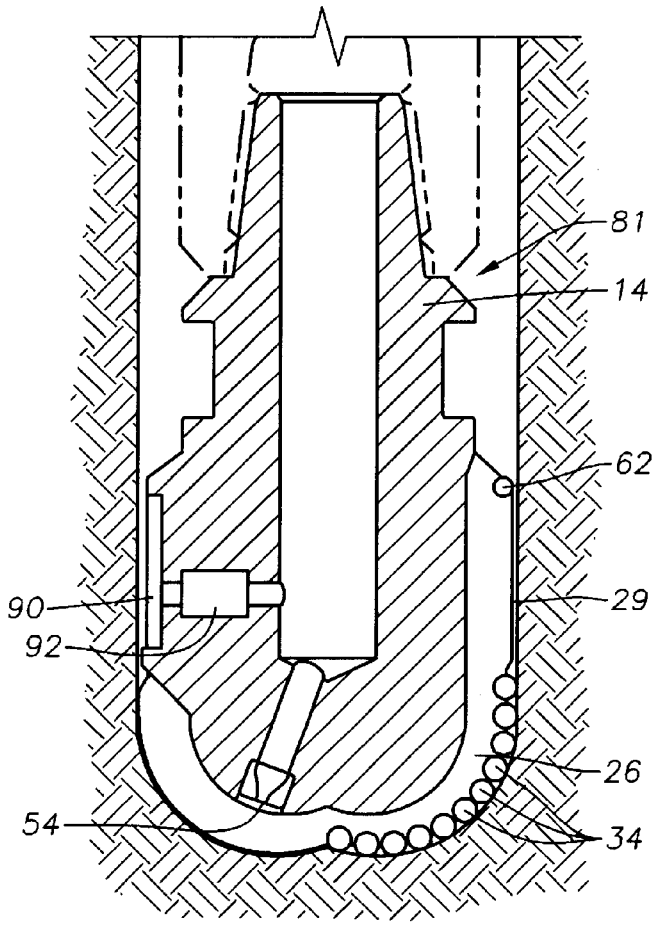

FIG. 10 illustrates a further drilling system. In the drilling system of FIG. 10, the drill bit used is not identical to that described hereinbefore, but rather is modified to incorporate, in its gauge region, a plurality of moveable pads 90 which are moveable radially outwardly to engage the wall of the borehole to permit the application of a side loading to the drill bit. The pads 90 are typically moveable under the action of hydraulic fluid, the application of fluid being controlled by a suitable control valve arrangement 92 to ensure that the pads 90 are extended and retracted at appropriate intervals to cause the application of the desired side loading to the drill bit. It will be appreciated that, in effect, the arrangement of FIG. 10 is a drill bit with an integral bias unit. The nature of the part of the drill bit which performs the biasing function may take a number of forms, for example it may take the form described and illustrated in U.S. Pat. No. 5,099,934, the content of which is incorporated herein by reference for all it discloses.

Although several drilling systems suitable for use with the drill bit of the invention are described hereinbefore, it will be appreciated that the drill bit may be used in conjunction with other types of steerable drilling system.

In the arrangements described hereinbefore, it is important to ensure that the angular orientation of the drill bit relative to the associated bias unit is such as to result in each blade being located angularly opposite one of the bias pads of the bias unit. The reason for this is that upon activation of the bias unit to cause the drill bit to be tilted within the borehole to attain the formation of a curve in the borehole, the cutters 62 located angularly opposite the activated bias pads become active rather than passive in the formation of the curve in the borehole. As a result, the side load applied to the drill bit by the bias pad is transmitted directly to the now active cutter located directly angularly opposite the active pad thus improving the efficiency of cutting and the efficiency with which the drilling direction can be changed. Obviously, if the angular orientation of the drill bit relative to the bias unit is such that the cutters 62 are not located angularly opposite the bias pads of the bias unit, the drilling efficiency of the downhole assembly when the drill bit is being used in the formation of a curve in the wellbore is not optimized.

Where the drill bit includes the same number or an even multiple of the number of blades as the bias unit has bias pads, then by appropriate angular orientation of the drill bit relative to the bias unit, it will be appreciated that optimization of the drilling efficiency during this phase of operation can be achieved. Such optimization can only be achieved, however, by ensuring that the correct angular orientation is achieved to locate each bias pad opposite a respective blade, and this can only occur where the bit and bias unit have the correct number of blades and bias pads. The bias unit and drill bit are each secured to the remainder of the drill string by screw threaded connections, and so it will be appreciated that it is difficult to consistently achieve the desired angular orientation of the bias unit and the drill bit.

Figure 11:
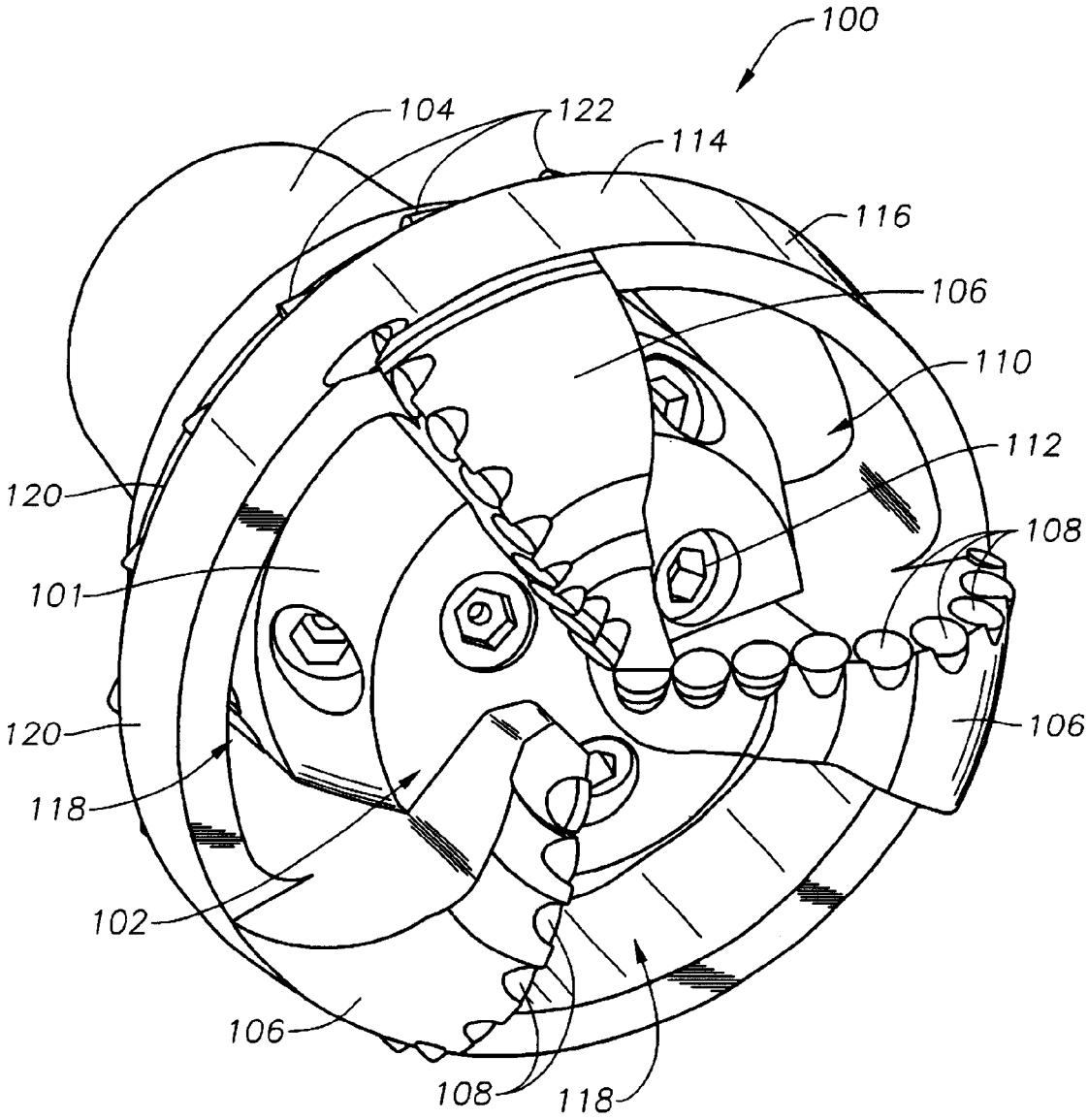
FIG. 11 is a perspective view illustrating another embodiment of the invention.
Figure 12:
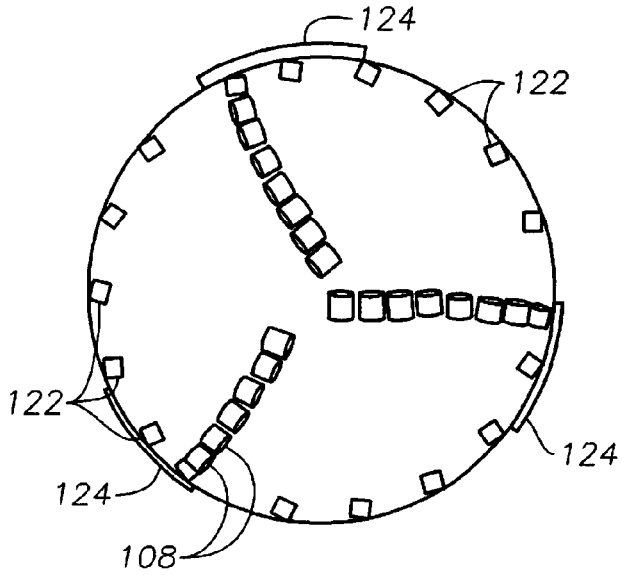
FIGS. 12 to 15 are diagrammatic views illustrating various angular positions of the drill bit of FIG. 11 relative to a bias unit.
Figure 13:
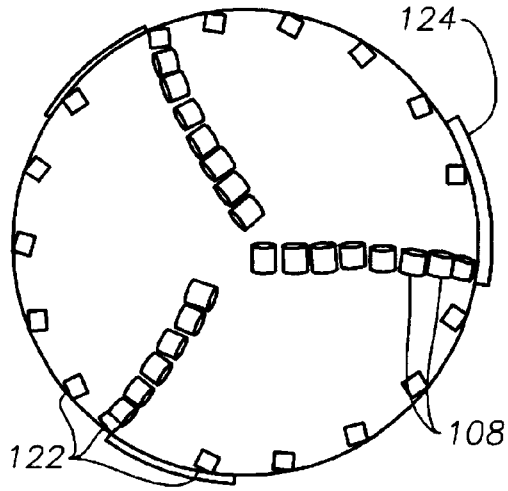
Figure 14:
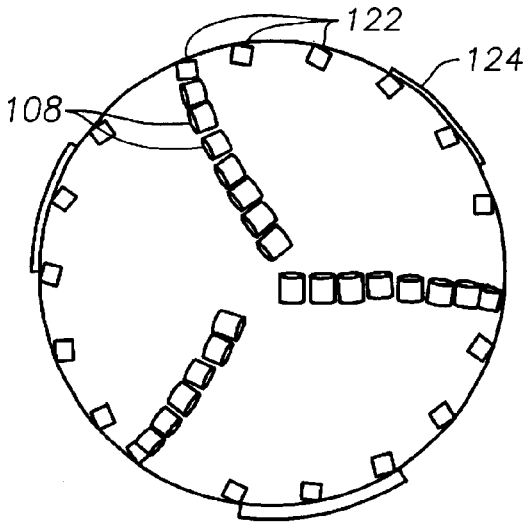
Figure 15:
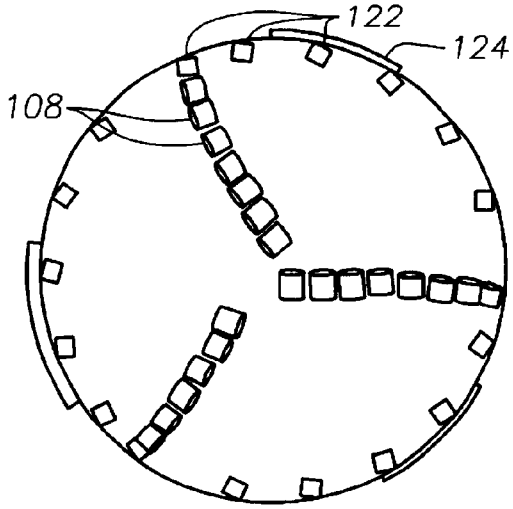

FIG. 11 illustrates a design of bit in which the drilling efficiency can be optimized without having to correctly angularly orientate the drill bit relative to a bias unit to locate each bias pad opposite a blade and also in which the bit need not be used with a bias unit having a number of bias pads determined by the number of blades of the drill bit. The drill bit 100 in FIG. 11 comprises a bit body 101 having a leading face 102 and a shank 104 for connection to a drill string. A plurality of blades 106 are upstanding from the leading face 102, each blade 106 extending outwardly away from a central axis of rotation of the bit 100 and each carrying a plurality of cutters 108 for engagement with a formation within which a borehole is to be drilled.

Between the blades 106 are formed flow channels 110 to which a drilling fluid is supplied, in use, through nozzles 112, the fluid being used to lubricate and clean the cutters 108, in use.

A gauge ring 114 encircles at least a portion of the bit body 101, the gauge ring 114 being integral with the remainder of the bit body 101 and defining a gauge surface 116. The gauge ring 114 connects at least two, and preferably all the gauge pads 28 or blades 106 to extend substantially continuously around the bit body 101. As shown in FIG. 11, openings 118 are formed in the gauge ring 114 to allow drilling fluid from the channels 110 to flow to the annulus between the drill string and the wall of the borehole.

The gauge ring 114 terminates, at its edge remote from the blade 106, with a gauge ring end wall 120. A plurality of cutters 122 are mounted on the gauge ring 114, the cutters 122 being positioned such that their cutting edges are located radially inward of the gauge surface 116, the axial position of each cutter 122 being such that the junction between the gauge surface 116 and the gauge pad end wall 120 crosses, radially, between the face of each cutter and the wall of the borehole.

It will be appreciated that the positioning of each cutter 122 of the arrangement illustrated in FIG. 11 is similar to that of the cutters 62 of the arrangements described hereinbefore, the main difference between the arrangement of FIG. 11 and the arrangements described hereinbefore being that cutters 122 are provided on portions of the gauge ring 114 angularly between the positions of the blades 106. As a result, if the drill bit of FIG. 11 is not angularly aligned with an associated bias unit with the result that the bias pads of the bias units are not angularly opposite the blades 106 which would, in the arrangements of FIGS. 1–10 result in the drilling efficiency of the arrangement not being optimized, in the arrangement of FIG. 11 drilling efficiency is still optimized as the bias pads are still located angularly opposite one or more of the cutters 122 even where the pads are not located angularly opposite the blades 106.

Some possible angular orientations of the drill bit relative to the bias unit are illustrated in FIGS. 12–15 which are diagrammatic representations showing the positions of the cutters 108, the cutters 122 and the bias pads 124 of the bias unit. It is clear from each of FIGS. 12–15 that in each of the relative positions of the bias pads 124 relative to the drill bit, the bias pads 124 are located angularly opposite at least one of the cutters 122. In service the pads 124 continuously extend and retract as the bit 100 rotates. Generally, one or more pads are partially extended simultaneously, as shown. The direction in which the bit 100 is pushed is a result of which pads are extended, and the amount they extend. Further, although not illustrated, it will be appreciated that the drill bit of FIG. 11 need not be used with a bias unit having three bias pads 124, but rather could be used with a bias unit having any number of bias pads.

As with the cutters 62, the distance by which the cutters 122 are spaced from the gauge surface is preferably greater than about 0.15 mm and is preferably between about 0.2 mm and about 0.5 mm. A notional line drawn between a junction between the gauge surface 116 and the gauge ring end wall 120 and the cutting edge of each cutter 122 conveniently makes an angle with the axis of the drill bit of less than about 0.1°.

In addition to allowing greater flexibility of choice of components used in the downhole assembly and reducing the requirement to angularly align the drill bit relative to the bias unit, the provision of the gauge ring 114 further assists in stabilizing the drill bit and thus may allow a reduction in the number of blades carried by the drill bit as compared to a conventional design.

Whereas the present invention has been described in particular relation to the drawings attached hereto, it should be understood that other and further modifications apart from those shown or suggested herein, may be made within the scope and spirit of the present invention.

We claim:

1. A drill bit for drilling a borehole, the drill bit comprising a bit body having an axis of rotation, a leading face, a plurality of blades upstanding from the leading face, at least two of the blades terminating in gauge pads, the gauge pads interconnected to form a continuous a gauge surface arranged, in use, to face a wall of the borehole, the gauge surface being devoid of cutting elements, the gauge surface terminating at an end thereof remote from the blade at a junction with an end wall, wherein the gauge pad carries a cutter having a face and a cutting edge located radially inward of the gauge surface, and wherein the junction of the gauge surface and the end wall crosses, radially, between the face of the cutter and the wall of the borehole.

2. The drill bit of claim 1, wherein each gauge pad carries a single cutter.

3. The drill bit of claim 1, wherein each cutter comprises a table of a superhard material bonded to a substrate.

4. The drill bit of claim 3, wherein the superhard material comprises diamond.

5. The drill bit of claim 1, wherein the cutting edge is spaced radially inward of the gauge surface by a distance greater than about 0.15 mm.

6. The drill bit of claim 5, wherein the cutting edge is spaced radially inward of the gauge surface by a distance between about 0.2 mm and about 0.55 m.

7. The drill bit of claim 1, wherein a notional line drawn between the cutting edge and the junction makes an angle with the axis of the bit of less than about 0.1°.

8. The drill bit of claim 1, wherein all the gauge pads are interconnected with one another to form a continuous gauge surface extending around the drill bit.

9. The drill bit of claim 8, further comprising at least one additional cutter having a face and a cutting edge located radially inward of the gauge surface, a junction between the gauge surface and the end wall being located so as to cross radially between the face of the additional cutter and the wall of the borehole, the additional cutter being located, angularly, between two adjacent blades of the drill bit.

10. A drill bit for drilling a borehole, the drill bit comprising a bit body having an axis of rotation, a leading face, a plurality of blades upstanding from the leading face, at least two of the blades terminating in gauge pads, the gauge pads interconnected to form a continuous a gauge surface arranged, in use, to face a wall of the borehole, the gauge surface being devoid of cutting elements, the gauge surface terminating at an end thereof remote from the blade at a junction with an end wall, wherein the gauge pad carries a cutter having a face and a cutting edge located radially inward of the gauge surface, the radial spacing of the cutting edge from the gauge surface being greater than about 0.15 mm.

11. The drill bit of claim 10, wherein all the gauge pads are interconnected with one another to form a continuous gauge surface extending around the drill bit.

12. The drill bit of claim 11, further comprising at least one additional cutter having a face and a cutting edge located radially inward of the gauge surface, a junction between the gauge surface and the end wall being located so as to cross radially between the face of the additional cutter and the wall of the borehole, the additional cutter being located, angularly, between two adjacent blades of the drill bit.

13. A drill bit for drilling a borehole, the drill bit comprising a bit body having an axis of rotation, a leading face, a plurality of blades upstanding from the leading face, at least two of the blades terminating in gauge pads, the gauge pads interconnected to form a continuous a gauge surface arranged, in use, to face a wall of the borehole, the gauge surface being devoid of cutting elements, the gauge surface terminating at an end thereof remote from the blade at a junction with an end wall, wherein the gauge pad carries a cutter having a face and a cutting edge located radially inward of the gauge surface, and wherein a notional line between the junction and the cutting edge makes an angle with the axis of rotation of less than about 0.1°.

14. The drill bit of claim 13, wherein all the gauge pads are interconnected with one another to form a continuous gauge surface extending around the drill bit.

15. The drill bit of claim 14, further comprising at least one additional cutter having a face and a cutting edge located radially inward of the gauge surface, a junction between the gauge surface and the end wall being located so as to cross radially between the face of the additional cutter and the wall of the borehole, the additional cutter being located, angularly, between two adjacent blades of the drill bit.

16. A drill bit for drilling a borehole, the drill bit comprising a bit body having an axis of rotation, a leading face, a plurality of blades upstanding from the leading face, at least two of the blades terminating in gauge pads, the gauge pads interconnected to form a continuous gauge surface arranged, in use, to face a wall of the borehole, the gauge surface being devoid of cutting elements, the gauge surface terminating at an end thereof remote from the blade at a junction with an end wall, wherein the gauge pad carries a cutter having a face and a cutting edge located radially inward of the gauge surface, and wherein an axial position of the junction of the gauge surface and the pad end wall lies between an axial position of an edge of the cutter face closest to the blade and an edge thereof furthest from the blade.

17. The drill bit of claim 16, wherein all the gauge pads are interconnected with one another to form a continuous gauge surface extending around the drill bit.

18. The drill bit of claim 17, further comprising at least one additional cutter having a face and a cutting edge located radially inward of the gauge surface, a junction between the gauge surface and the end wall being located so as to cross radially between the face of the additional cutter and the wall of the borehole, the additional cutter being located, angularly, between two adjacent blades of the drill bit.

19. A steerable drilling system for use in the drilling of a borehole comprising a bottom hole assembly adapted to permit control over the direction of drilling of a drill bit, the drill bit comprising a bit body having a plurality of blades, at least two of the blades terminating in gauge pads, the gauge pads interconnected to form a continuous gauge surface arranged, in use, to face a wall of the borehole, the gauge surface being devoid of cutting elements, the gauge surface terminating at an end thereof remote from the blade at a junction with an end wall, wherein the gauge pad carries a cutter located inward of the gauge surface and such that an axial position of a junction between the gauge surface and the end wall lies between an axial position of an edge of the cutter closest to the blade and an axial position of an edge of the cutter furthest from the blade.

20. The drilling system of claim 19, wherein the bottom hole assembly is of the "push the bit" type.

21. The drilling system of claim 20, wherein the bottom hole assembly includes a bias unit arranged to apply a side loading to the bit.

22. The drilling system of claim 20, wherein the drill bit is provided with a plurality of movable pads, movable to apply a side load to the drill bit.

23. The drilling system of claim 19, wherein the bottom hole assembly is of the "point of the bit" type.

24. The drilling system of claim 23, wherein the bottom hole assembly includes a downhole motor for rotating the drill bit, and an angled member arranged to permit the bit to be supported in a desired orientation relative to an axis of the borehole.

25. The drilling system of claim 19, wherein all the gauge pads are interconnected with one another to form a continuous gauge surface extending around the drill bit.

26. The drilling system of claim 25, further comprising at least one additional cutter having a face and a cutting edge located radially inward of the gauge surface, a junction between the gauge surface and the end wall being located so as to cross radially between the face of the additional cutter and the wall of the borehole, the additional cutter being located, angularly, between two adjacent blades of the drill bit.

27. A drill bit for drilling a borehole, the drill bit comprising a bit body having an axis of rotation, a leading face, a plurality of blades upstanding from the leading face, and a continuous gauge surface extending around the bit body and arranged, in use, to face a wall of the borehole, the gauge surface being devoid of cutting elements, the gauge surface terminating at an edge thereof remote from the blades at a junction with a gauge pad end wall, wherein the bit body carries a plurality of cutters each having a face and a cutting edge located radially inward of the gauge surface, and wherein the junction of the gauge surface and the gauge pad end wall crosses, radially, between the face of each cutter and the wall of the borehole.

28. The drill bit of claim 27, wherein each cutter comprises a table of a superhard material bonded to a substrate.

29. The drill bit of claim 28, wherein the superhard material comprises diamond.

30. The drill bit of claim 27, wherein the cutting edge is spaced radially inwardly of the gauge surface by a distance greater than about 0.15 mm.

31. The drill bit of claim 30, wherein the cutting edge is spaced radially inwardly of the gauge surface by a distance between about 0.2 mm and about 0.5 mm.

32. The drill bit of claim 27, wherein a notional line drawn between the cutting edge and the junction makes an angle with the axis of the bit of less than about 0.1°.

* * * * *